US011712096B1

(12) United States Patent
Rayner

(10) Patent No.: US 11,712,096 B1
(45) Date of Patent: Aug. 1, 2023

(54) ILLUMINATED BACKPACK ASSEMBLY

(71) Applicant: William Christopher Rayner, Henderson, NV (US)

(72) Inventor: William Christopher Rayner, Henderson, NV (US)

( * ) Notice: Subject to any disclaimer, the term of this patent is extended or adjusted under 35 U.S.C. 154(b) by 0 days.

(21) Appl. No.: 17/984,700

(22) Filed: Nov. 10, 2022

(51) Int. Cl.
*A45C 15/06* (2006.01)
*A45F 3/04* (2006.01)

(52) U.S. Cl.
CPC ..... *A45C 15/06* (2013.01); *A45F 3/04* (2013.01)

(58) Field of Classification Search
CPC ..... A45C 15/06; A45F 3/04
See application file for complete search history.

(56) References Cited

U.S. PATENT DOCUMENTS 5,508,900 A * 4/1996 Norman ..... A42B 3/0406 362/106
10,383,313 B2 8/2019 Bartol
10,502,351 B2 12/2019 Jaeger
2009/0201671 A1 8/2009 Huntley
2009/0212081 A1 8/2009 Liang
2015/0335135 A1* 11/2015 Stoll ..... F21L 4/08 362/108
2019/0059562 A1 2/2019 Escava
2020/0154865 A1 5/2020 Morganti

* cited by examiner

*Primary Examiner* — Thomas M Sember

(57) ABSTRACT

An illuminated backpack assembly includes a backpack that is wearable on a user's back. A plurality of light strips is each attached to the backpack to emit light outwardly from the backpack. Each of the light strips is strategically positioned on the backpack for enhancing visibility of the backpack in a darkened environment to facilitate the user to be visually identified by a companion from a distance in the darkened environment. A communication unit is integrated into the backpack and the communication unit is in remote communication with a personal electronic device. The communication unit is in communication with each of the light strips and the communication unit downloads an operational subroutine from the personal electronic device. In this way the light strips can be actuated according to the operational subroutine to enhance the ornamental appearance of the backpack.

6 Claims, 5 Drawing Sheets

ILLUMINATED BACKPACK ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to backpack device and more particularly pertains to a new backpack device for enhancing visibility of a user wearing a backpack. The device includes a backpack and a plurality of light strips attached to the backpack. The device includes a communication unit in remote communication with a personal electronic device for downloading an operational subroutine for the light strips. The device includes a rechargeable battery integrated into the backpack for powering the light strips and the communication unit.

(2) Description of Related Art Including Information Disclosed Under 37 CFR 1.97 and 1.98

The prior art relates to backpack devices including a hydration system that includes a backpack that is wearable on a user's back, a fluid reservoir integrated into the backpack and a fluid delivery system that includes a magnetic quick disconnect. The prior art discloses a stimulating wearable device that includes a backpack, a stimulus means integrated into the backpack and a motion sensor for actuating the stimulus means. The prior art discloses a hydration system that includes a backpack, a hydration reservoir which has a plurality of compartments and a baffle. The prior art discloses hydration backpack that stores and disburses a fluid and which includes a hood being wearable on a user's head and eyewear integrated into the hood.

BRIEF SUMMARY OF THE INVENTION

An embodiment of the disclosure meets the needs presented above by generally comprising a backpack that is wearable on a user's back. A plurality of light strips is each attached to the backpack to emit light outwardly from the backpack. Each of the light strips is strategically positioned on the backpack for enhancing visibility of the backpack in a darkened environment to facilitate the user to be visually identified by a companion from a distance in the darkened environment. A communication unit is integrated into the backpack and the communication unit is in remote communication with a personal electronic device. The communication unit is in communication with each of the light strips and the communication unit downloads an operational subroutine from the personal electronic device. In this way the light strips can be actuated according to the operational subroutine to enhance the ornamental appearance of the backpack.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
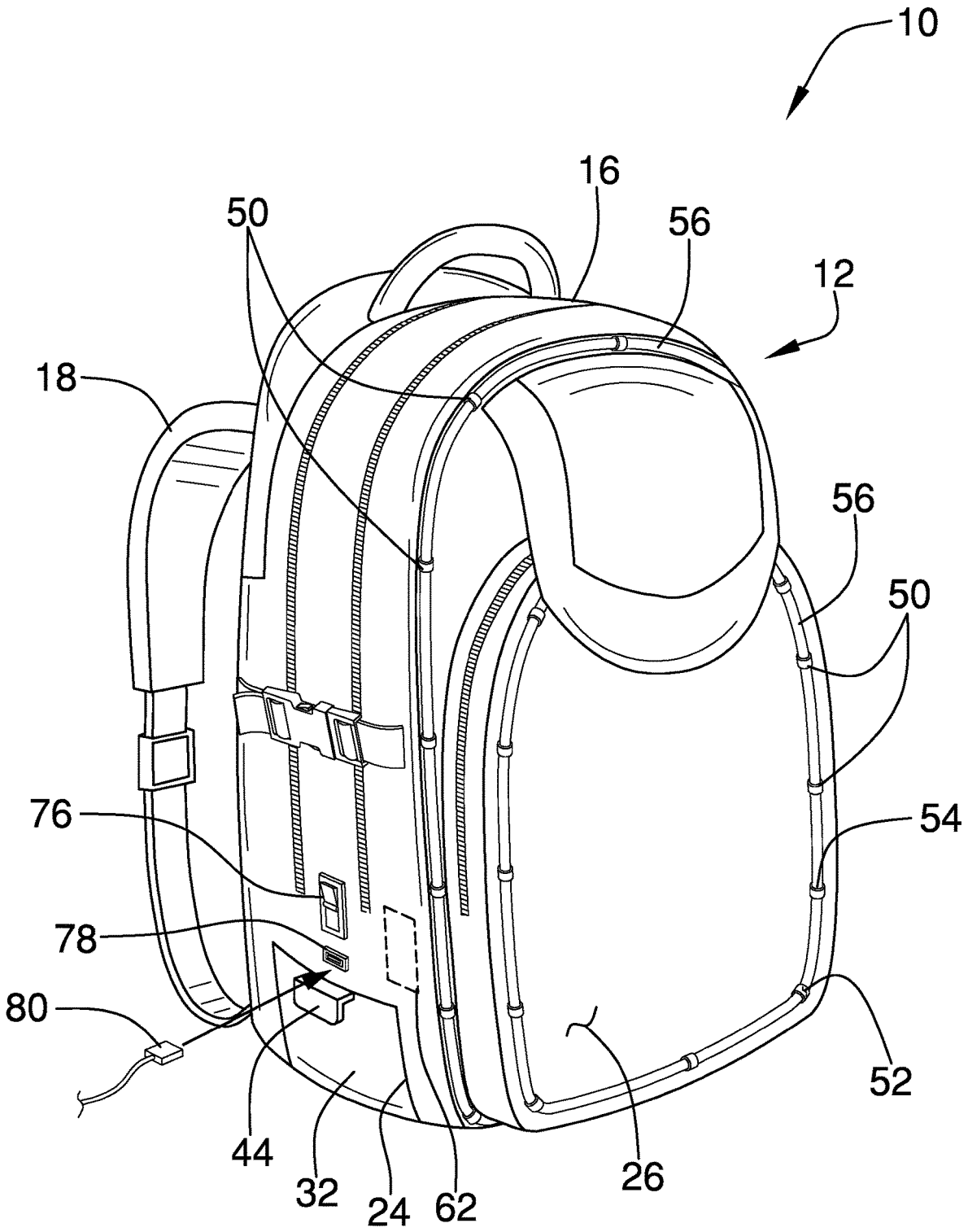
FIG. 1 is a perspective view of a illuminated backpack assembly according to an embodiment of the disclosure.
Figure 2:
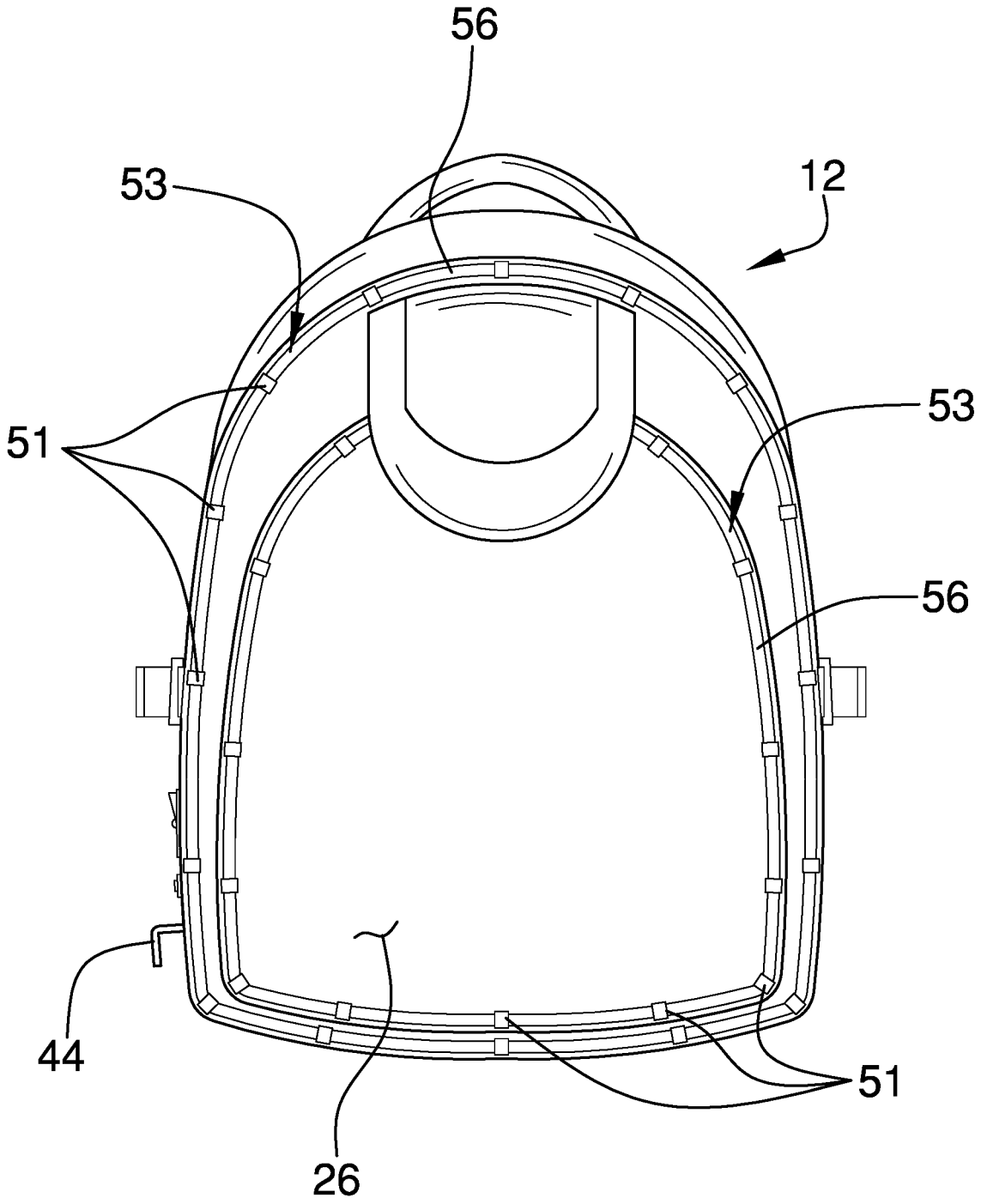
FIG. 2 is a back view of an embodiment of the disclosure.
Figure 3:
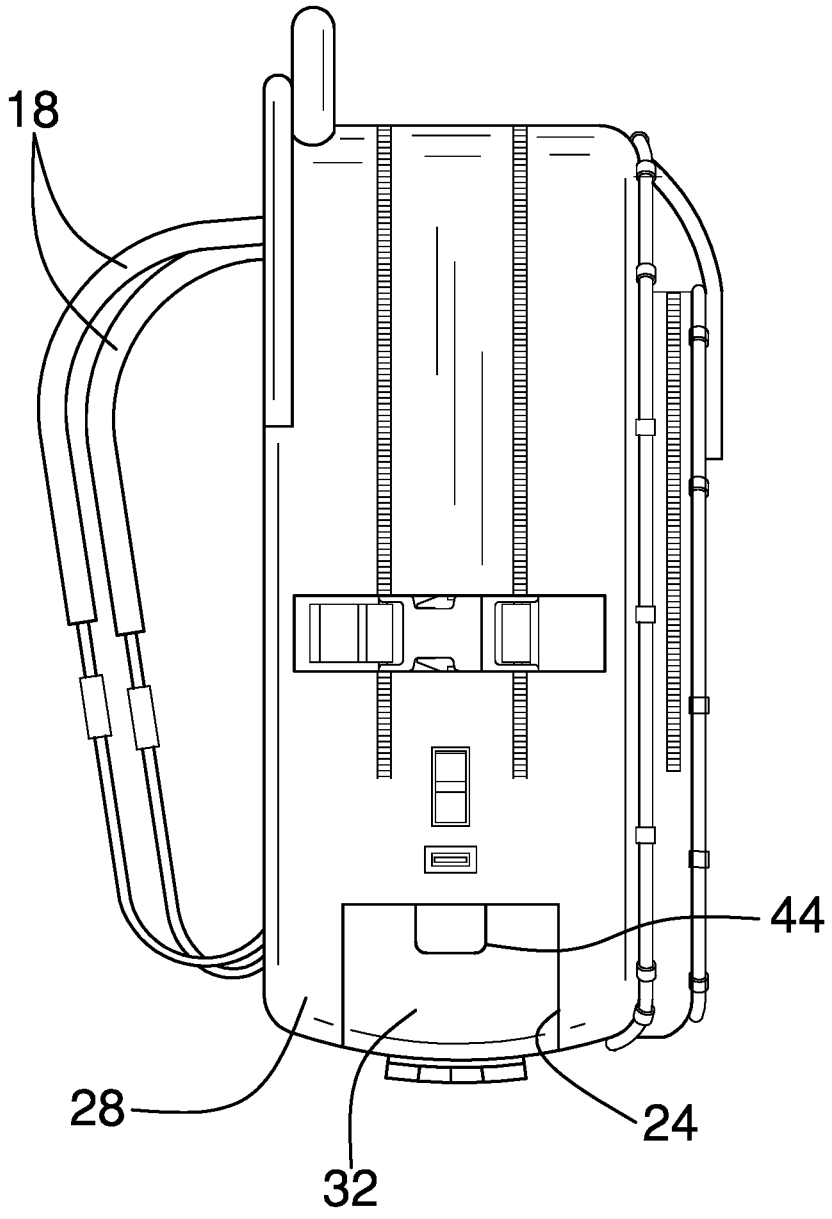
FIG. 3 is a left side view of an embodiment of the disclosure.
Figure 4:
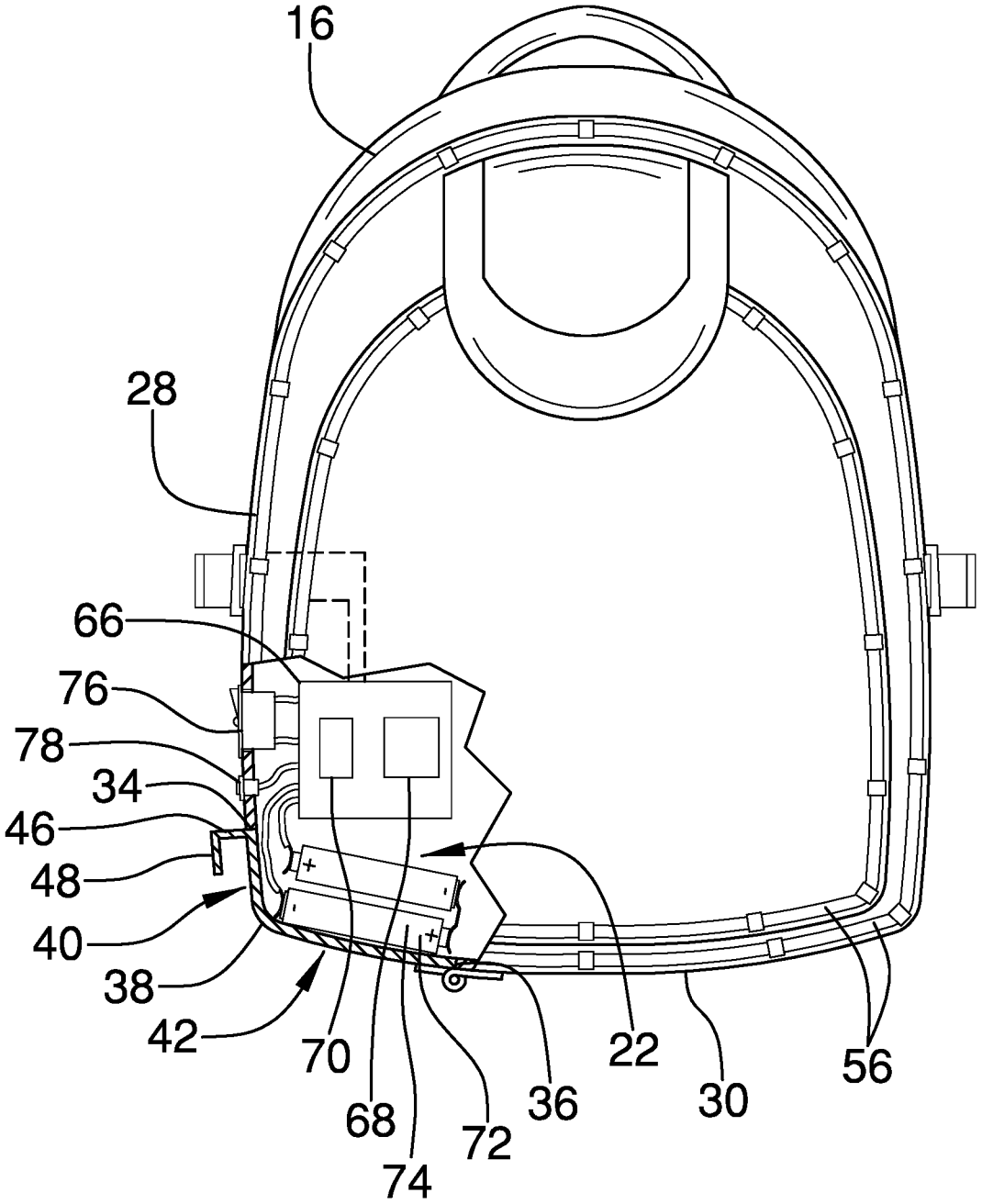
FIG. 4 is a back cut-away view of an embodiment of the disclosure.
Figure 5:
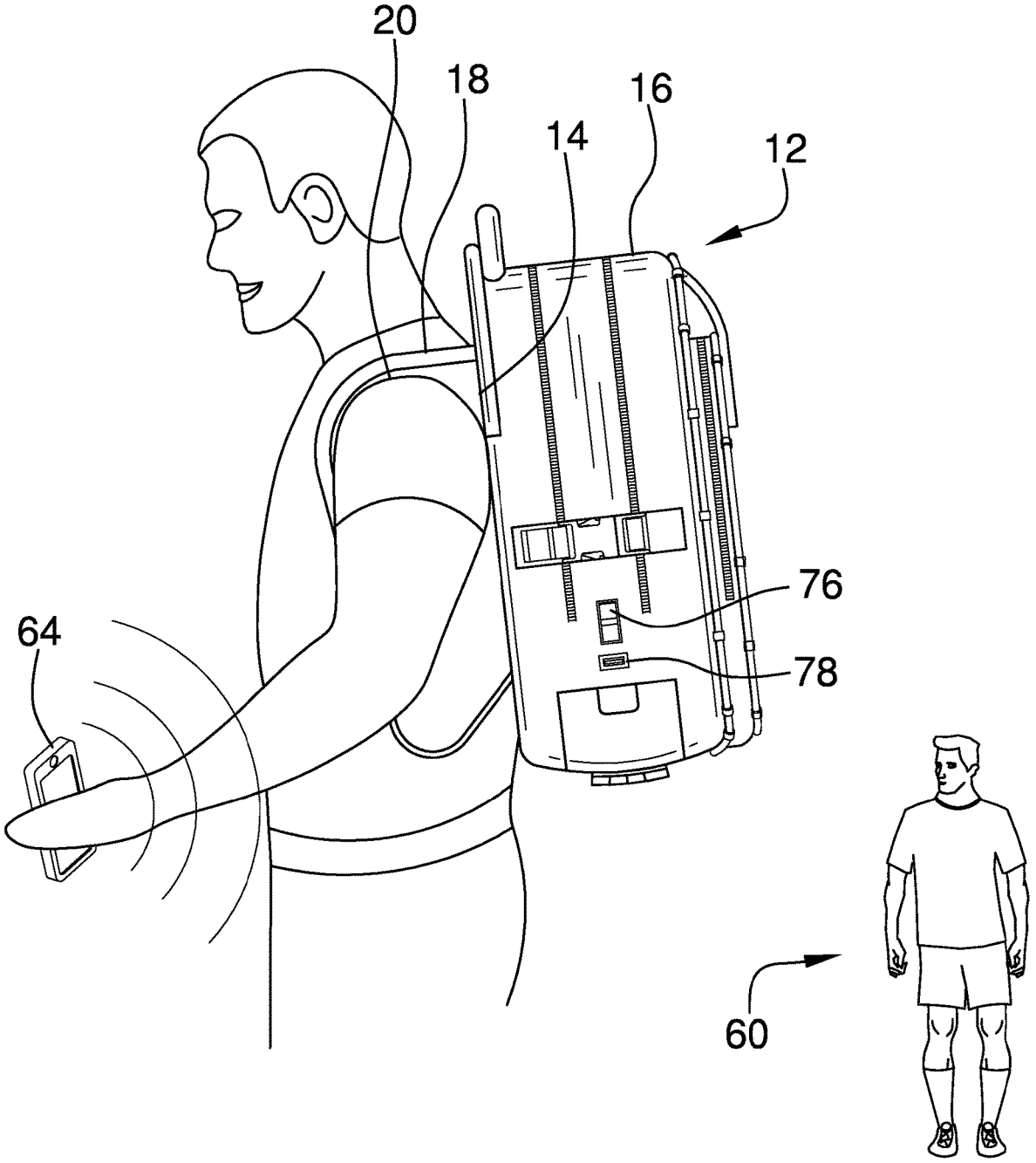
FIG. 5 is a perspective in-use view of an embodiment of the disclosure.

With reference now to the drawings, and in particular to FIGS. 1 through 5 thereof, a new backpack device embodying the principles and concepts of an embodiment of the disclosure and generally designated by the reference numeral 10 will be described.

As best illustrated in FIGS. 1 through 5, the illuminated backpack assembly 10 generally comprises a backpack 12 that is wearable on a user's back 14. The backpack 12 has a storage bag 16 and a pair of shoulder straps 18 that is each coupled to the storage bag 16 thereby facilitating each of the shoulder straps 18 to be worn over a respective one of the user's shoulders 20 having the storage bag 16 being positioned on the user's back 14. The backpack 12 may comprise a hydration pack of any conventional design, a book bag or any conventional design or any conceivable type of backpack. The backpack 12 has a battery compartment 22 that is integrated in the storage bag 16 and the storage bag 16 has an access opening 24 extending through an outer surface 26 of the storage bag 16 and into the battery compartment 22.

The access opening 24 extends through a lateral wall 28 of the storage bag 16 and a bottom wall 30 of the storage bag 16.

A door 32 is hingedly coupled to the backpack 12 and the door 32 is aligned with the battery compartment 22 for opening or closing the battery compartment 22. The door 32 has a first edge 34 and a second edge 36 and the door 32 has a curve 38 that is positioned between the first edge 34 and the second edge 36 to define a first portion 40 of the door 32 forming an angle with a second portion 42 of the door 32. The first edge 34 is associated with the first portion 40 and the second edge 36 is associated with the second portion 42. The second edge 36 is hingedly coupled to the bottom wall 30 of the storage bag 16 and the second portion 42 lies on a plane that is oriented coplanar with the bottom wall 30 when the door 32 is in a closed position. The first portion 40 lies on a plane that is oriented coplanar with the lateral wall 28 of the storage bag 16 when the door 32 is in the closed position. The door 32 closes the access opening 24 when the door 32 is in the closed position and the door 32 exposing the access opening 24 when the door 32 is in the open position.

A handle 44 is coupled to the door 32 thereby facilitating the handle 44 to be gripped for opening or closing the door 32. The handle 44 comprises a leg 46 extending outwardly from the first portion 40 of the door 32 and a foot 48 extending downwardly from the leg 46 such that the foot 48 is spaced from the first portion 40. Additionally, the leg 46 is aligned with the first edge 34 of the door 32. A plurality of eyelets 50 is provided and each of the eyelets 50 has an exterior surface 52 that is attached to the outer surface 26 of the storage bag 16. Each of the eyelets 50 is oriented such that an opening 54 defined by each of the eyelets 50 extends along an axis that is oriented parallel to the outer surface 26. The plurality of eyelets 50 is arranged into a plurality of sets of eyelets 51 and each of the sets of eyelets 51 is arranged to define a respective circuitous route 53 on the storage bag 16.

A plurality of light strips 56 is provided and each of the light strips 56 is attached to the backpack 12 to emit light outwardly from the backpack 12. Each of the light strips 56 is strategically positioned on the backpack 12 for enhancing visibility of the backpack 12 in a darkened environment. In this way the plurality of light strips 56 facilitate the user 58 to be visually identified by a companion 60 from a distance in the darkened environment. Respective ones of the light strips 56 extend through each of a respective one of the sets of eyelets 51 thereby facilitating the respective light strip 56 to follow the respective circuitous route 53 defined by the respective set of eyelets 51. In this way each of the light strips 56 defines a readily identifiable pattern for the companion 60. Each of the light strips 56 may comprise a plurality of light emitting diodes that are distributed within a translucent member or other similar type of electronic light strip. Furthermore, each of the light strips 56 may be capable of emitting light in a variety of different colors and patterns.

A communication unit 62 is integrated into the backpack 12 and the communication unit 62 is in remote communication with a personal electronic device 64. The communication unit 62 is in communication with each of the light strips 56 and the communication unit 62 downloads an operational subroutine from the personal electronic device 64. In this way the light strips 56 can be actuated according to the operational subroutine to enhance the ornamental appearance of the backpack 12. The personal electronic device 64 may comprise a smart phone or other similar device that has wireless communication capabilities and data storage capabilities. Furthermore, the personal electronic device 64 may store a smart phone application that is designed for controlling the color of light emitted by the light strips 56 and a pattern expressed by sequentially flashing the light strips 56 on and off.

The communication unit 62 comprises a control circuit 66 that is integrated into the storage bag 16. Each of the light strips 56 is electrically coupled to the control circuit 66 and the control circuit 66 includes an electronic memory 68. A receiver 70 is integrated into the storage bag 16 and the receiver 70 is electrically coupled to the control circuit 66. The receiver 70 is in wireless communication with the personal electronic device 64 for downloading the operational subroutine into the electronic memory 68. The receiver 70 may comprise a radio frequency receiver or the like and the receiver 70 may employ Bluetooth communication protocols.

A power supply 72 is integrated into the backpack 12 and the power supply 72 is electrically coupled to each of the light strips 56. The power supply 72 comprises a rechargeable battery 74 that is disposed within the battery compartment 22 in the storage bag 16. The power supply 72 includes a power switch 76 that is movably integrated into the outer surface 26 of the storage bag 16 thereby facilitating the power switch 76 to be manipulated by the user 58. The power switch 76 is electrically coupled between the rechargeable battery 74 and the control circuit 66. Furthermore, the power switch 76 is positionable in an on position for turning on each of the light strips 56 and the power switch 76 is positionable in an off position for turning off each of the light strips 56. The power supply 72 includes a charge port 78 that is recessed into the outer surface 26 of the storage bag 16 thereby facilitating the charge port 78 to insertably receive a charge cord 80. The charge port 78 is electrically coupled to the rechargeable battery 74 for charging the rechargeable battery 74. The charge port 78 may comprise a universal serial bus port or other similar type of charge port and the charge cord 80 may comprise a universal serial bus cord or other type of charge cord that is matable to the charge port 78.

In use, the personal electronic device 64 is synchronized with the receiver 70 for downloading the operational subroutine into the electronic memory 68. The power switch 76 is turned on to turn on each of the light strips 56. In this way the light strips 56 emits light such that the backpack 12 can be visually identified by the companion 60 of the user 58. Thus, the user 58 can be located at a large public event, such as a concert for example, at a distance by the companion 60 thereby ensuring the companion 60 and the user 58 do not become separated from each other. The charge cord 80 is plugged into the charge port 78 for recharging the rechargeable battery 74 on an as needed basis.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An illuminated backpack assembly for enhancing visibility of an individual in a darkened environment, said assembly comprising:

a backpack being wearable on a user's back, said backpack having a storage bag and a pair of shoulder straps each being coupled to said storage bag thereby facilitating each of said shoulder straps to be worn over a respective one of the user's shoulders having said storage bag being positioned on the user's back, said backpack having a battery compartment being integrated in said storage bag;

a door being hingedly coupled to said backpack, said door being aligned with said battery compartment for opening or closing said battery compartment;

a handle being coupled to said door thereby facilitating said handle to be gripped for opening or closing said door;

a plurality of light strips, each of said light strips being attached to said backpack wherein each of said light strips is configured to emit light outwardly from said backpack, each of said light strips being strategically positioned on said backpack for enhancing visibility of said backpack in a darkened environment wherein said plurality of light strips is configured to facilitate the user to be visually identified by a companion from a distance in the darkened environment; and a communication unit being integrated into said backpack, said communication unit being in remote communication with a personal electronic device, said communication unit being in communication with each of said light strips, said communication unit downloading an operational subroutine from the personal electronic device thereby facilitating said light strips to be actuated according to said operational subroutine wherein said light strips are configured to enhance the ornamental appearance of said backpack;

a plurality of eyelets, each of said eyelets having an exterior surface, said exterior surface of each of said eyelets being attached to an outer surface of said storage bag, each of said eyelets being oriented such that an opening defined by each of said eyelets extends along an axis being oriented parallel to said outer surface; and said plurality of eyelets is arranged into a plurality of sets of eyelets, each of said sets of eyelets being arranged to define a respective circuitous route on said storage bag.

2. The assembly according to claim 1, wherein respective ones of said light strips extends through each of a respective one of said sets of eyelets thereby facilitating said respective light strip to follow said respective circuitous route defined by said respective set of eyelets wherein each of said light strips is configured to define a readily identifiable pattern for the companion.

3. The assembly according to claim 1, wherein said communication unit comprises:

a control circuit being integrated into said storage bag, each of said light strips being electrically coupled to said control circuit, said control circuit including an electronic memory; and a receiver being integrated into said storage bag, said receiver being electrically coupled to said control circuit, said receiver being in wireless communication with the personal electronic device for downloading said operational subroutine into said electronic memory.

4. The assembly according to claim 1, further comprising a power supply being integrated into said backpack, said power supply being electrically coupled to each of said light strips, said power supply comprising:

a rechargeable battery being disposed within said battery compartment in said storage bag;

a power switch being movably integrated into said outer surface of said storage bag thereby facilitating said power switch to be manipulated by the user, said power switch being electrically coupled between said rechargeable battery and said control circuit, said power switch being positionable in an on position for turning on each of said light strips, said power switch being positionable in an off position for turning off each of said light strips; and a charge port being recessed into said outer surface of said storage bag thereby facilitating said charge port to insertably receive a charge cord, said charge port being electrically coupled to said rechargeable battery for charging said rechargeable battery.

5. An illuminated backpack assembly for enhancing visibility of an individual in a darkened environment, said assembly comprising:

a backpack being wearable on a user's back, said backpack having a storage bag and a pair of shoulder straps each being coupled to said storage bag thereby facilitating each of said shoulder straps to be worn over a respective one of the user's shoulders having said storage bag being positioned on the user's back, said backpack having a battery compartment being integrated in said storage bag;

a door being hingedly coupled to said backpack, said door being aligned with said battery compartment for opening or closing said battery compartment;

a handle being coupled to said door thereby facilitating said handle to be gripped for opening or closing said door;

a plurality of light strips, each of said light strips being attached to said backpack wherein each of said light strips is configured to emit light outwardly from said backpack, each of said light strips being strategically positioned on said backpack for enhancing visibility of said backpack in a darkened environment wherein said plurality of light strips is configured to facilitate the user to be visually identified by a companion from a distance in the darkened environment;

a communication unit being integrated into said backpack, said communication unit being in remote communication with a personal electronic device, said communication unit being in communication with each of said light strips, said communication unit downloading an operational subroutine from the personal electronic device thereby facilitating said light strips to be actuated according to said operational subroutine wherein said light strips are configured to enhance the ornamental appearance of said backpack;

wherein said storage bag has an access opening extending through an outer surface of said storage bag and into said battery compartment, said access opening extending through a lateral wall of said storage bag and a bottom wall of said storage bag;

wherein said door has a first edge and a second edge, said door having a curve being positioned between said first edge and said second edge to define a first portion of said door forming an angle with a second portion of said door, said first edge being associated with said first portion, said second edge being associated with said second portion, said second edge being hingedly coupled to said bottom wall of said storage bag, said second portion lying on a plane being oriented coplanar with said bottom wall when said door is in a closed position, said first portion lying on a plane being oriented coplanar with said lateral wall of said storage bag when said door is in said closed position, said door closing said access opening when said door is in said closed position, said door exposing said access opening when said door is in said open position; and wherein said handle comprises a leg extending outwardly from said first portion of said door and a foot extending downwardly from said leg such that said foot is spaced from said first portion, said leg being aligned with said first edge of said door.

6. An illuminated backpack assembly for enhancing visibility of an individual in a darkened environment, said assembly comprising:

a backpack being wearable on a user's back, said backpack having a storage bag and a pair of shoulder straps each being coupled to said storage bag thereby facilitating each of said shoulder straps to be worn over a respective one of the user's shoulders having said storage bag being positioned on the user's back, said backpack having a battery compartment being integrated in said storage bag, said storage bag having an access opening extending through an outer surface of said storage bag and into said battery compartment, said access opening extending through a lateral wall of said storage bag and a bottom wall of said storage bag;

a door being hingedly coupled to said backpack, said door being aligned with said battery compartment for opening or closing said battery compartment, said door having a first edge and a second edge, said door having a curve being positioned between said first edge and said second edge to define a first portion of said door forming an angle with a second portion of said door, said first edge being associated with said first portion, said second edge being associated with said second portion, said second edge being hingedly coupled to said bottom wall of said storage bag, said second portion lying on a plane being oriented coplanar with said bottom wall when said door is in a closed position, said first portion lying on a plane being oriented coplanar with said lateral wall of said storage bag when said door is in said closed position, said door closing said access opening when said door is in said closed position, said door exposing said access opening when said door is in said open position;

a handle being coupled to said door thereby facilitating said handle to be gripped for opening or closing said door, said handle comprising a leg extending outwardly from said first portion of said door and a foot extending downwardly from said leg such that said foot is spaced from said first portion, said leg being aligned with said first edge of said door;

a plurality of eyelets, each of said eyelets having an exterior surface, said exterior surface of each of said eyelets being attached to said outer surface of said storage bag, each of said eyelets being oriented such that an opening defined by each of said eyelets extends along an axis being oriented parallel to said outer surface, said plurality of eyelets being arranged into a plurality of sets of eyelets, each of said sets of eyelets being arranged to define a respective circuitous route on said storage bag;

a plurality of light strips, each of said light strips being attached to said backpack wherein each of said light strips is configured to emit light outwardly from said backpack, each of said light strips being strategically positioned on said backpack for enhancing visibility of said backpack in a darkened environment wherein said plurality of light strips is configured to facilitate the user to be visually identified by a companion from a distance in the darkened environment, respective ones of said light strips extending through each of a respective one of said sets of eyelets thereby facilitating said respective light strip to follow said respective circuitous route defined by said respective set of eyelets wherein each of said light strips is configured to define a readily identifiable pattern for the companion;

a communication unit being integrated into said backpack, said communication unit being in remote communication with a personal electronic device, said communication unit being in communication with each of said light strips, said communication unit downloading an operational subroutine from the personal electronic device thereby facilitating said light strips to be actuated according to said operational subroutine wherein said light strips are configured to enhance the ornamental appearance of said backpack, said communication unit comprising:

a control circuit being integrated into said storage bag, each of said light strips being electrically coupled to said control circuit, said control circuit including an electronic memory; and a receiver being integrated into said storage bag, said receiver being electrically coupled to said control circuit, said receiver being in wireless communication with the personal electronic device for downloading said operational subroutine into said electronic memory; and a power supply being integrated into said backpack, said power supply being electrically coupled to each of said light strips, said power supply comprising:

a rechargeable battery being disposed within said battery compartment in said storage bag;

a power switch being movably integrated into said outer surface of said storage bag thereby facilitating said power switch to be manipulated by the user, said power switch being electrically coupled between said rechargeable battery and said control circuit, said power switch being positionable in an on position for turning on each of said light strips, said power switch being positionable in an off position for turning off each of said light strips; and a charge port being recessed into said outer surface of said storage bag thereby facilitating said charge port to insertably receive a charge cord, said charge port being electrically coupled to said rechargeable battery for charging said rechargeable battery.

* * * * *